US007217341B2

(12) United States Patent
Luoma et al.

(10) Patent No.: US 7,217,341 B2
(45) Date of Patent: May 15, 2007

(54) TREATMENT EQUIPMENT, INCLUDING A BEAM, FOR A PAPER MACHINE

(75) Inventors: Pentti Luoma, Jyskä (FI); Olli Tuominen, Valkkinen (FI)

(73) Assignee: Metso Paper, Inc., Helsinki (FI)

( * ) Notice: Subject to any disclaimer, the term of this patent is extended or adjusted under 35 U.S.C. 154(b) by 425 days.

(21) Appl. No.: 10/799,007

(22) Filed: Mar. 12, 2004

(65) Prior Publication Data

US 2005/0121164 A1 Jun. 9, 2005

(30) Foreign Application Priority Data

Mar. 14, 2003 (FI) ..... 20035033

(51) Int. Cl.
*D21G 3/00* (2006.01)

(52) U.S. Cl. ..... 162/272; 162/281; 15/256.53

(58) Field of Classification Search ..... 162/199, 162/280–282, 272, 274, 352, 358.1; 100/174; 101/425, 350.6; 15/256.51, 256.52, 256.53; 118/261, 413, 118, 126
See application file for complete search history.

(56) References Cited

U.S. PATENT DOCUMENTS 4,372,203 A 2/1983 Brasa
4,637,338 A * 1/1987 Wohrle ..... 118/126
5,868,841 A * 2/1999 Halmschlager ..... 118/413

* cited by examiner

*Primary Examiner*—Eric Hug
(74) *Attorney, Agent, or Firm*—Fildes & Outland, P.C.

(57) ABSTRACT

The invention relates to treatment equipment, including a beam, for a paper machine. The beam (12) is equipped with a shaft (15), which has a bearing assembly (16) adapted to allow the beam (12) to pivot in relation to the bearing assembly (16) as well as move in the axial direction. The treatment equipment (10) further comprises a support device (18) and an oscillator (17). The support device (18) comprises a swing arm (19) and an actuator (20) connected thereto. In connection with the bearing assembly (16) there is an auxiliary arm (21), which is adapted free in the radial direction and locked in the axial direction in relation to the bearing assembly (16). In addition, there is a connection (22) between the swing arm (19) and the auxiliary arm (21), allowing the swing arm (19) to move in the axial direction in relation to the auxiliary arm (21) without a radial distortion of the swing arm (19). The invention also relates to similar treatment equipment without an actuator.

11 Claims, 6 Drawing Sheets

TREATMENT EQUIPMENT, INCLUDING A BEAM, FOR A PAPER MACHINE

Figure 1A:
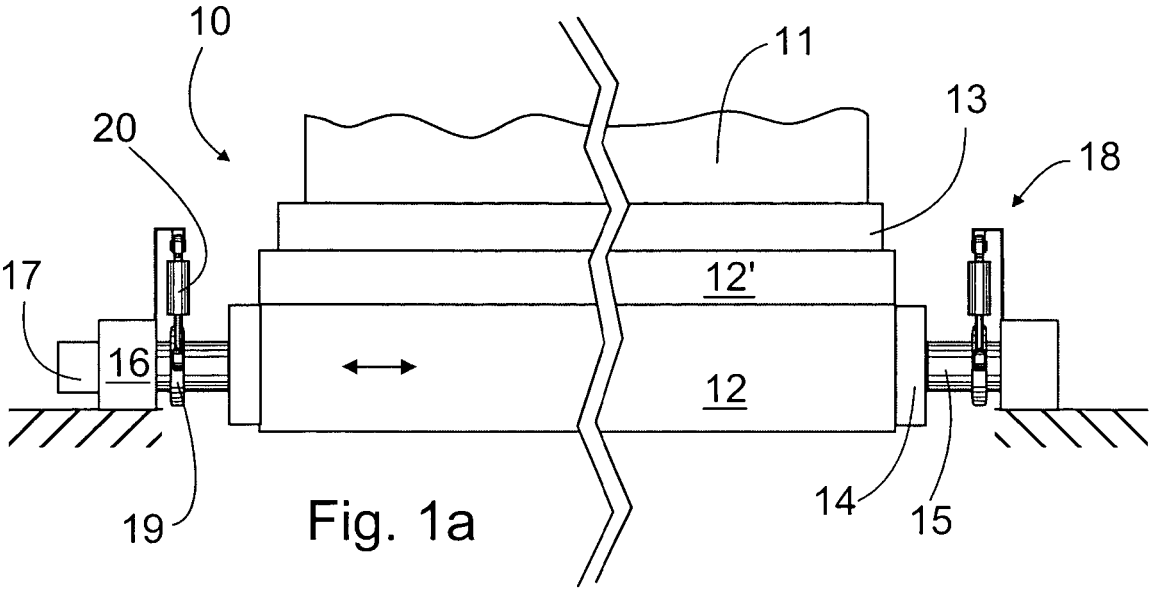

This invention relates to treatment equipment, including a beam, for a paper machine, the beam having a shaft at both of its end components, equipped with a bearing assembly, which is attached to the paper machine frame and adapted to allow the beam to pivot in relation to the bearing assembly and move in the axial direction, and the said treatment equipment further comprising a support device at least in one of the end components of the beam for turning the beam, and an oscillator for moving the beam back and forth in the axial direction, and the said support device comprising a swing arm immovably set on the shaft and an actuator connected thereto. The invention also relates to similar treatment equipment without an actuator.

Several doctors are used in paper machines as well as in other forming machines. In connection with rolls and cylinders, in particular, the doctors are used to remove the paper web to the pulper. The doctor is also used to clean the surface of a roll or a cylinder. The surface to be cleaned is usually doctored with a doctor blade, which is attached to the doctor beam by means of its blade holder. The beam is supported by its shafts with bearing assemblies, which allow the beam to move in the axial direction as well. As the result, an oscillator arranged in the doctor provides a lateral oscillating movement for the beam, which improves the cleaning performance and reliability of the doctor blade. At least at one end of the beam, the shaft is additionally fitted with a support device, which enables turning the doctor to the desired position by using the actuator of the support device. In addition to turning, the support device also keeps the doctor in the adjusted position.

A Finnish utility model No. 3718 sets forth a doctor, in which a simple hydraulic cylinder can be used as the actuator for the support device. The hydraulic cylinder is connected to a swing arm included in the support device, and the swing arm is connected to a shaft. Between the swing arm and the shaft there is a cogged joint, which not only permits the oscillating movement, but also transmits the turning movement. That is, the swing arm is kept in place during the shaft movement. However, the manufacture of a cogged joint is laborious and expensive. In addition, the proposed support device requires a large installation space, especially in the vertical direction. The cogged joint also inevitably becomes large in size, and remarkable frictional forces are then generated on its counter surfaces, which increases the power requirement of the oscillator. Furthermore, turning of the beam for example to the service position is impossible.

Doctors are also used in coating as well as without an actuator for turning the beam. In this case the beam is set to a desired position and the doctor blade is turned by means of loading hoses adapted to the blade holder. In the prior art technique, the swing arm arranged in the beam is supported to the bearing assembly or generally to the paper machine frame by means of a turnbuckle screw. In this case, the oscillating movement of the beam makes the turnbuckle screw swing, which further leads to distortion of the beam. In practice, the beam is in a continuous rotary motion, which produces uneven wear of the doctor blade. Also, the frictional force generated by the doctor blade varies, which makes the resistance caused by the doctoring vary. For example, the dryer groups of a paper machine have several doctors. The effect of resistance is remarkable, when the resistance peaks of several individual doctors apply simultaneously. In this case, running of the entire paper machine becomes jerking, which hampers the production and causes web breaks. This jerking also stresses the gearings and the electric motors actuating them.

The object of this invention is to provide novel treatment equipment, including a beam, for a paper machine, being more economical to manufacture and use than heretofore and having a larger opening angle than before. Another object of the invention is to provide treatment equipment, with which the disadvantages of the prior art technique are avoided. The characteristics of the treatment equipment according to this invention become evident from the appended claims 1 and 8. In the treatment equipment according to the invention, the support device has a novel design, which permits both the turning movement and the axial movement of the beam. In spite of this, the support device and its actuator, if any, can be securely attached without harmful bending stresses. Also, the construction is easy to install in existing treatment equipment. In addition, the construction requires only a reduced space for installation. Additionally, the application of the support device is independent of the doctor or oscillator used. With a simple design, the back and forth rotary motion of the beam caused by oscillation can be avoided.

Figure 1B:
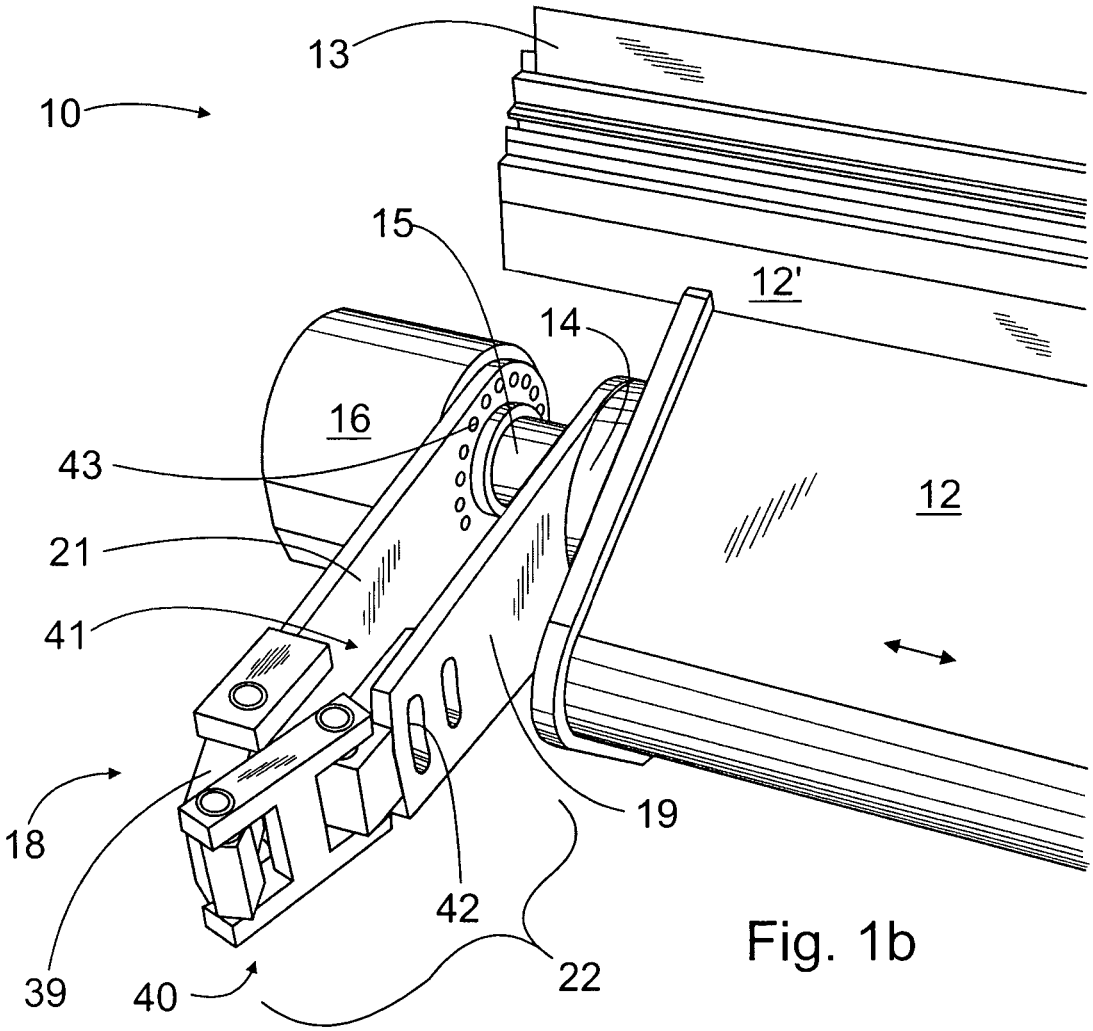
Figure 2B:
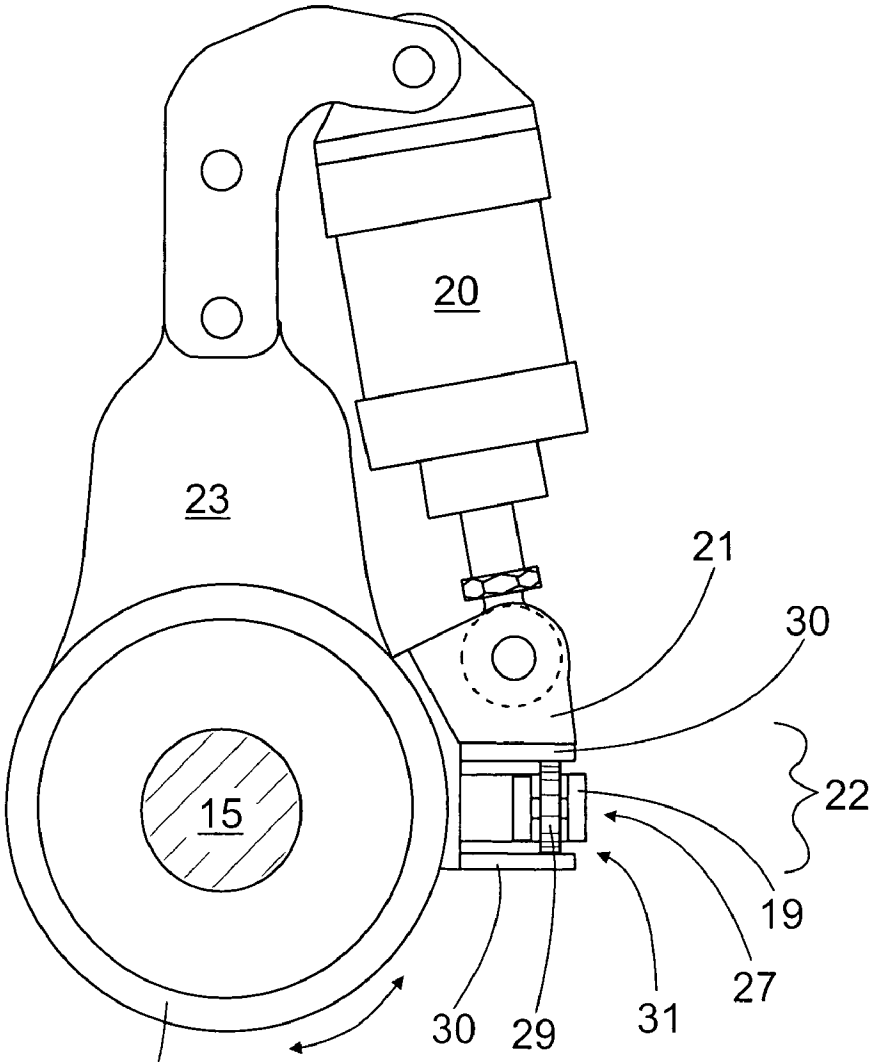
Figure 2A:
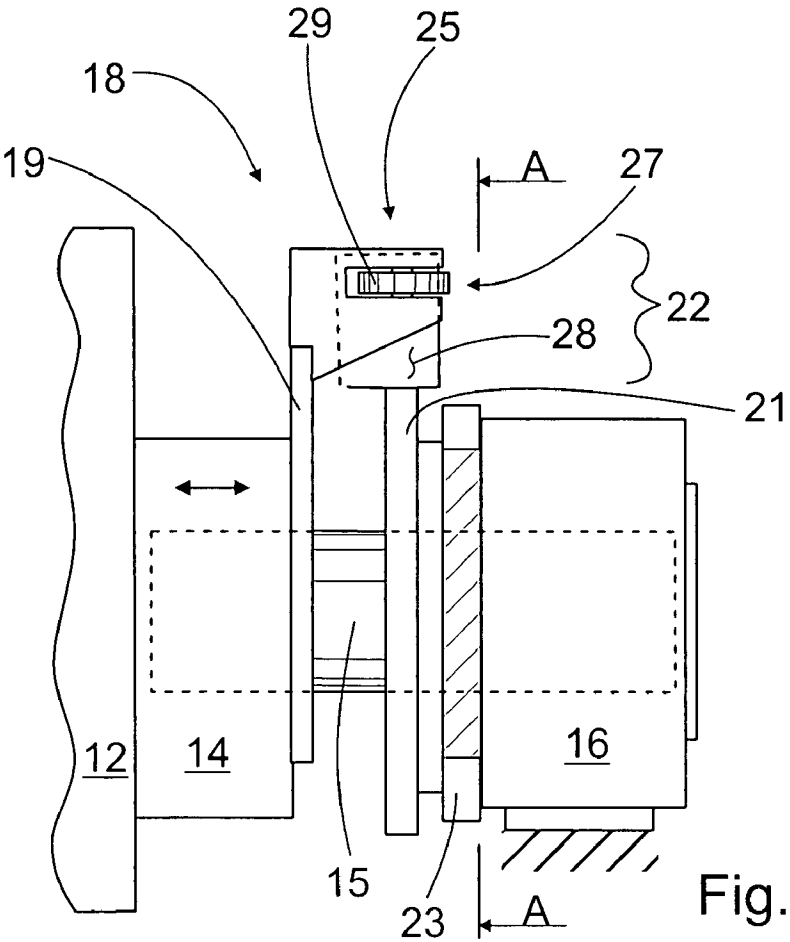

The invention is described below in detail by making reference to the enclosed drawings, which illustrate some of the embodiments of the invention, in which FIG. 1*a* is a principal drawing of a front view of the doctor according to the invention shown in the machine direction, FIG. 1*b* is an axonometric view of the end component of the treatment equipment according to the invention, FIG. 2*a* is a top view of the end component of the treatment equipment according to the invention, FIG. 2*b* is a sectional side view in plane A—A of the end component illustrated in FIG. 2*a,*

Figure 3A:
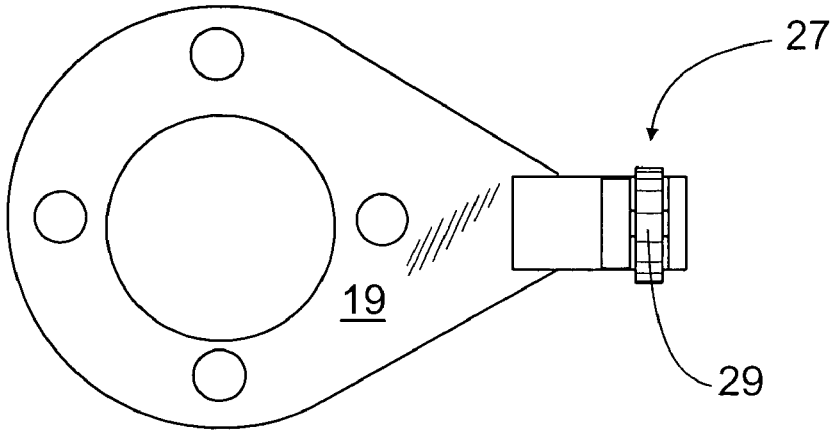
Figure 3B:
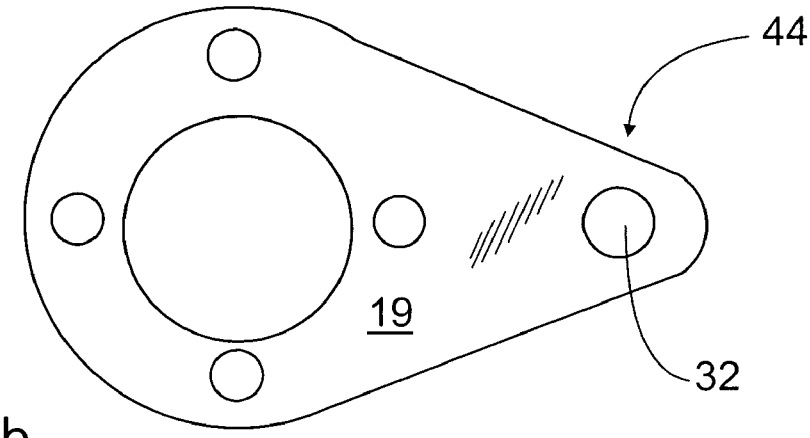

FIG. 3*a* shows a part of the support device illustrated in FIG. 2*b* separated from the construction, FIG. 3*b* shows a second embodiment of the component illustrated in FIG. 2*b,*

Figure 3C:
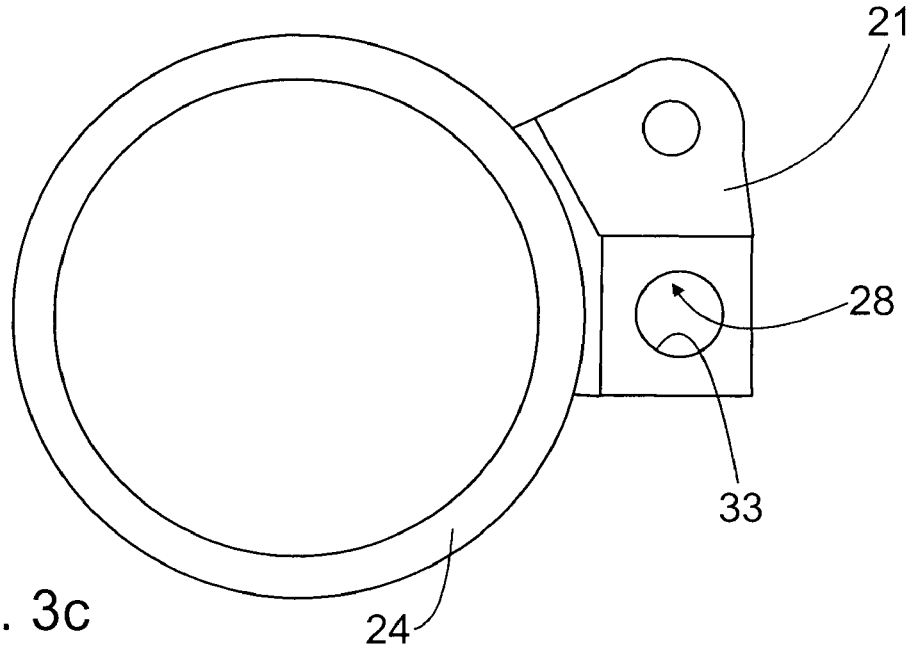
Figure 4A:
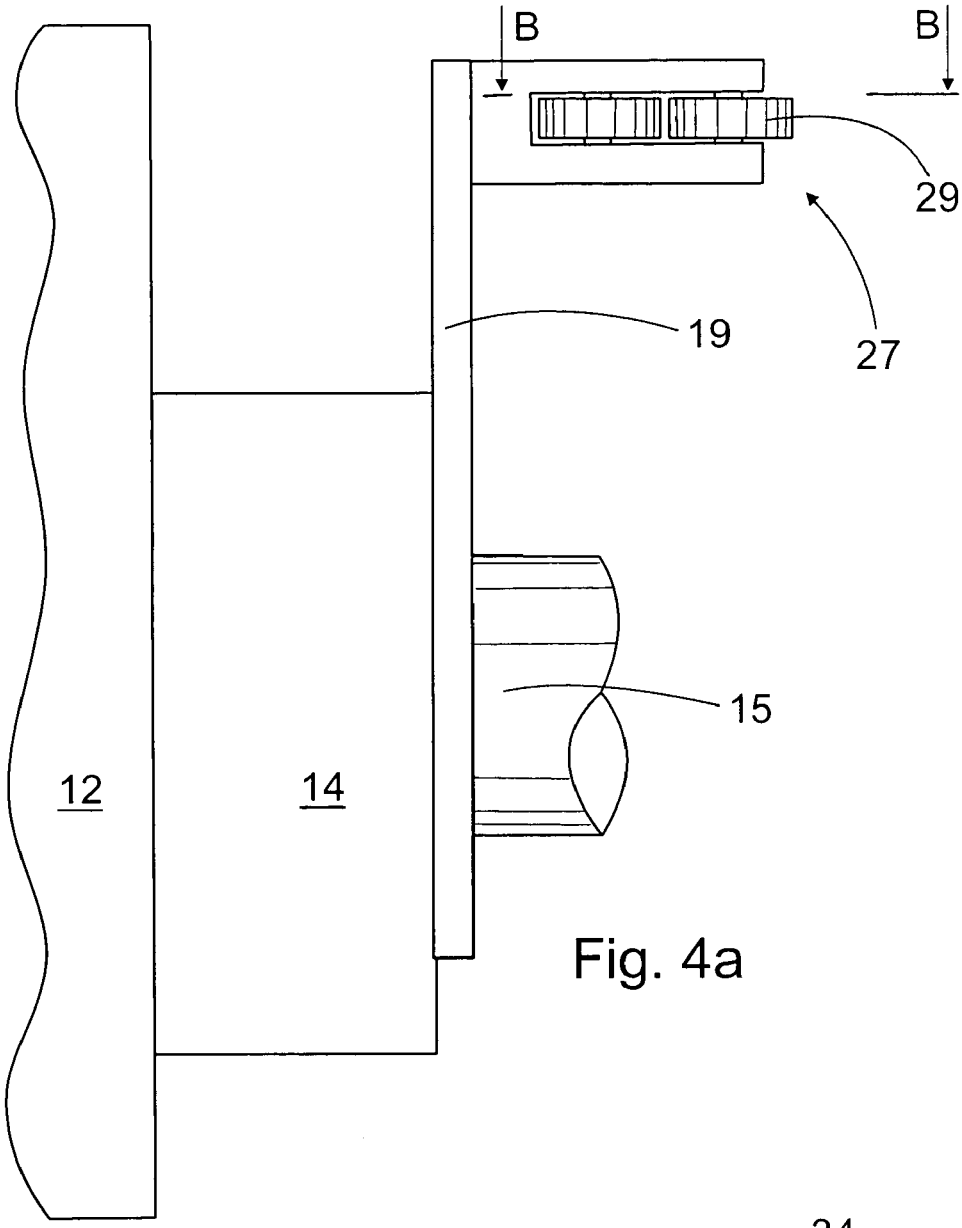
Figure 4B:
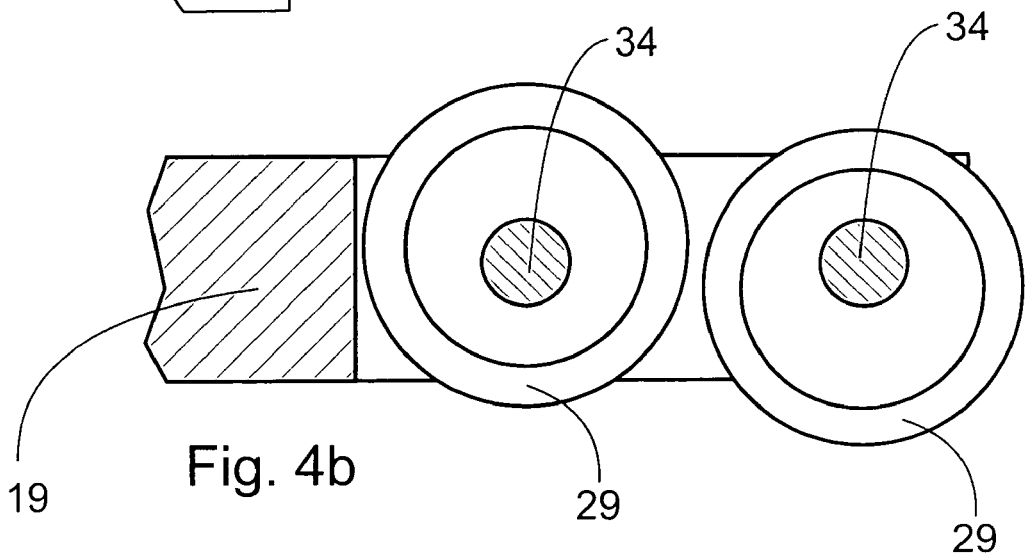

FIG. 3*c* shows the counter component of FIG. 3*b* separated from the construction, FIG. 4*a* shows a modification of the part of the support device illustrated in FIG. 3*a*, connected to the beam, FIG. 4*b* is s sectional view in plane B—B of FIG. 4*a,*

Figure 5A:
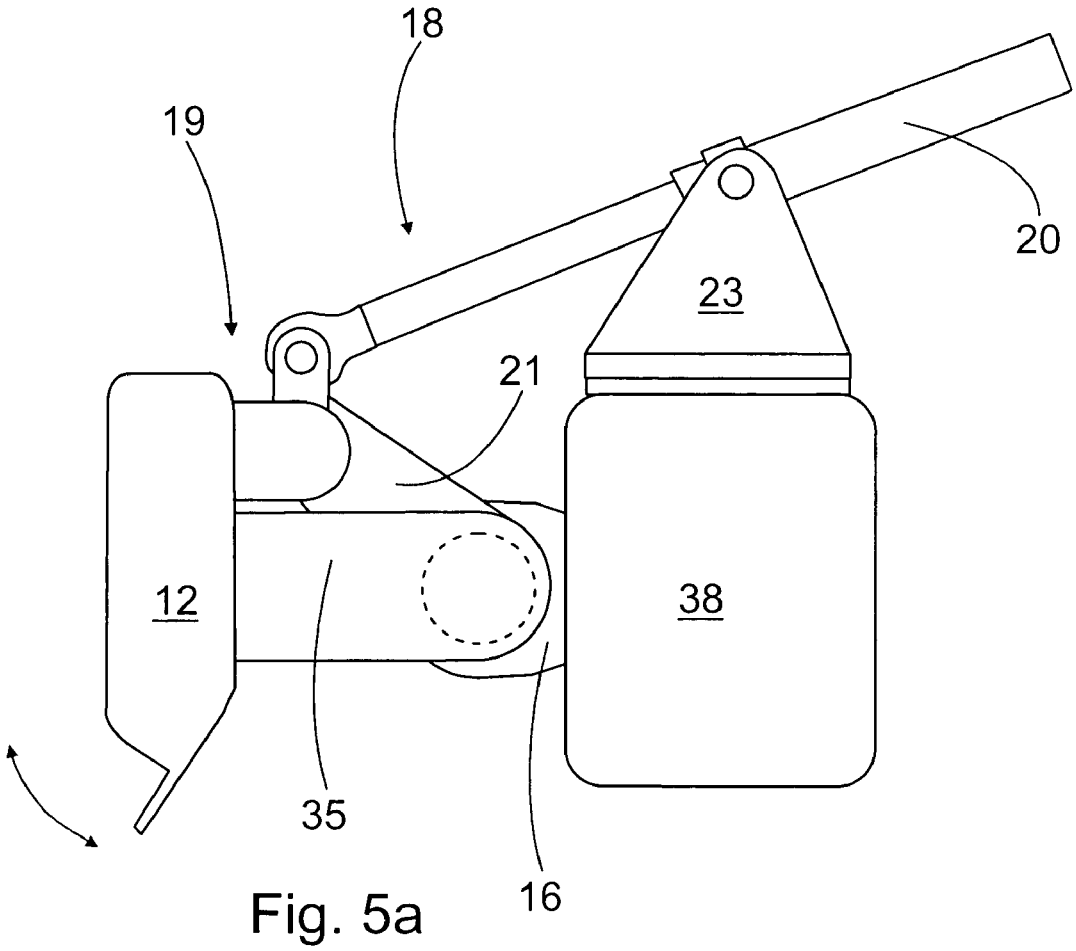
Figure 5B:
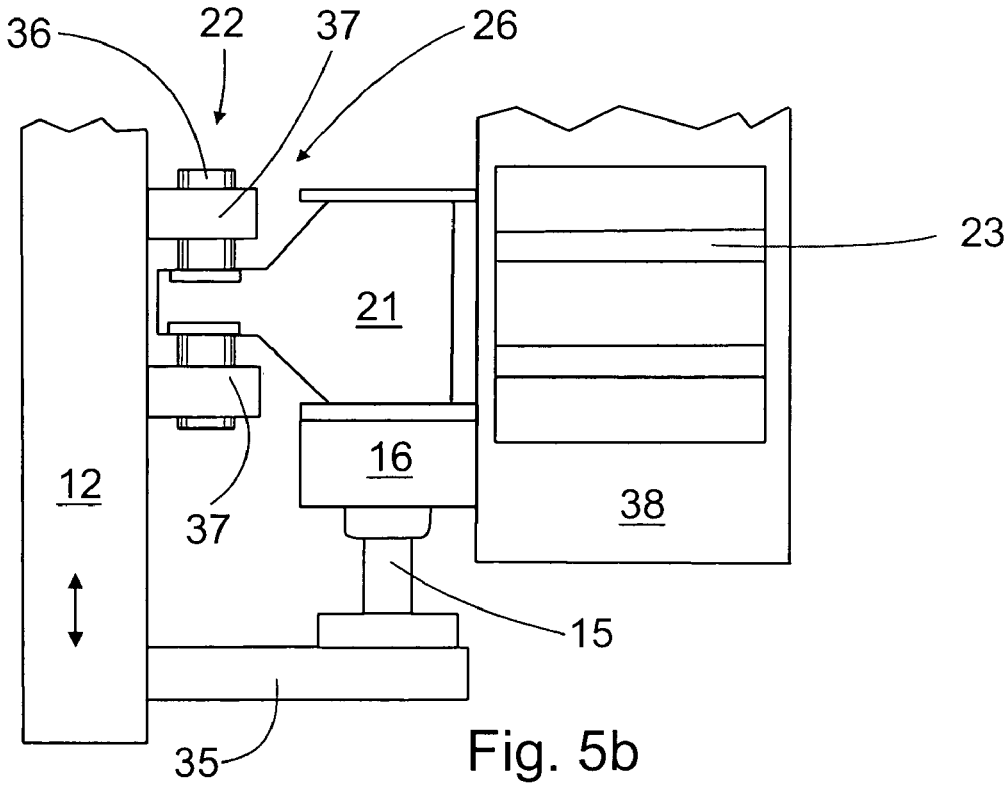

FIG. 5*a* is a side view of the second embodiment of the end component of the treatment equipment according to the invention, FIG. 5*b* is a top view of the end component of FIG. 5*a,*

Figure 6A:
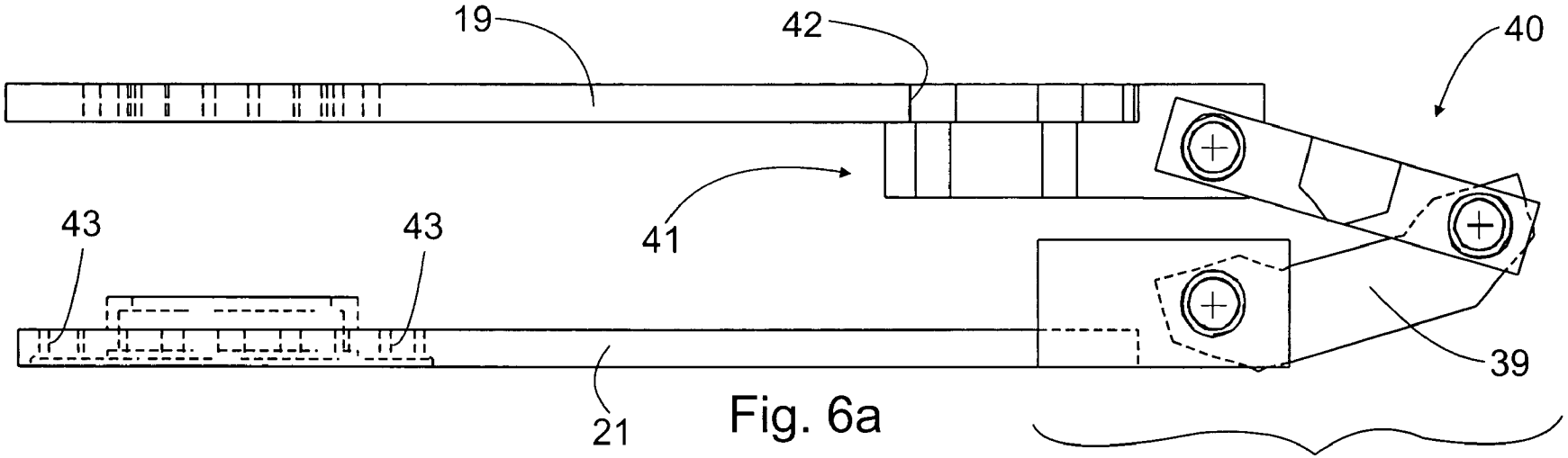
Figure 6B:
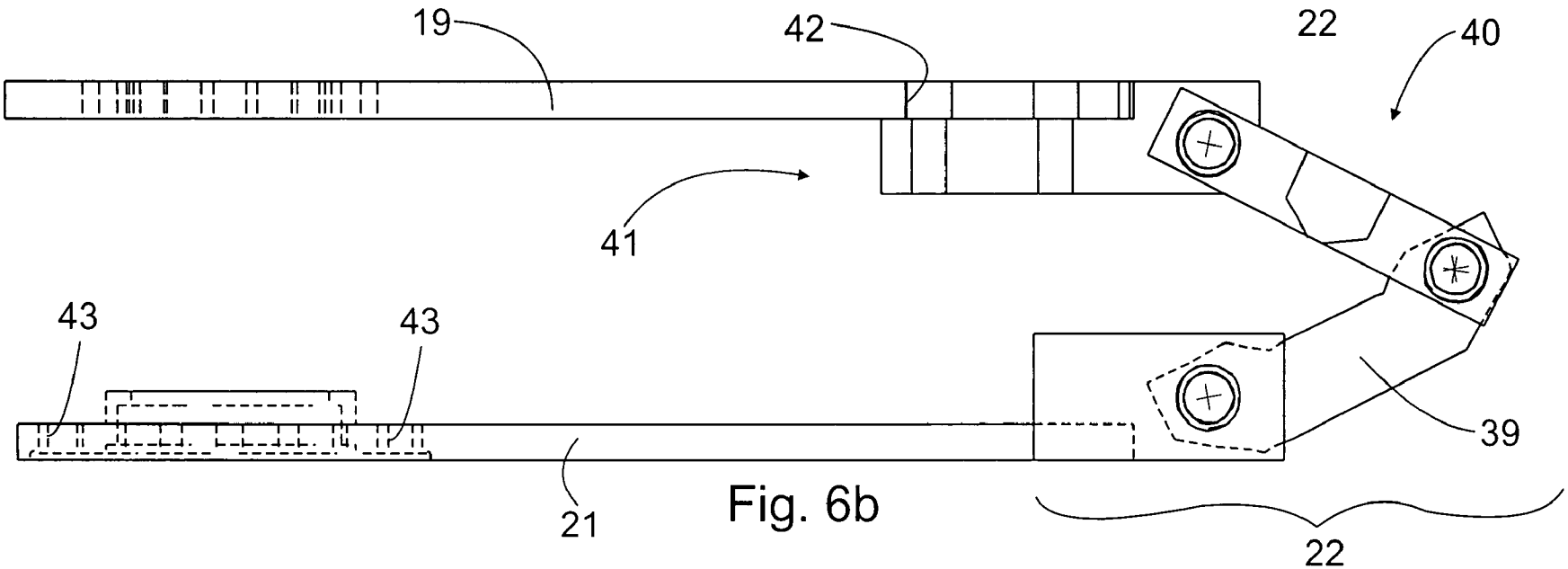

FIG. 6*a* shows the brackets of the treatment equipment according to the invention at the first end station of the oscillating movement, FIG. 6*b* shows the brackets of FIG. 6*a* at the second end station of the oscillating movement.

In FIG. 1*a*, the treatment equipment according to the invention is a doctor 10, which is arranged in connection with a roll 11. The surface of the roll 11 is doctored by means of a doctor blade 13 set in a blade holder 12', with the doctor blade pointing here diagonally upwards. The blade holder 12' is attached to the beam 12 of the doctor 10. Due to the beam, sufficient rigidity is achieved for the doctor, allowing thus to support the doctor solely at its ends. Besides the beam, another sufficiently rigid construction can also be used. Shafts 15 are attached to the ends of the beam 12 by means of flanges 14, the shafts being supported to the paper machine frame with bearing assemblies 16. As is well known, such bearing assemblies have a special construction, thus allowing for the beam to both pivot in relation to the bearing assembly and to move in the axial direction. In FIG.

1*a* there is additionally an oscillator 17 at the other end of the shaft line, the oscillator being of a certain known type, and hence its construction is not set forth here. The oscillator 16 provides a back and forth linear motion, indicated with a double-headed arrow in FIG. 1*a*, to the beam 12. The stroke length of the oscillator is typically 10–20 mm.

In addition to the above, the doctor 10 also comprises a support device 18 at least at one of the ends of the beam 12. In FIG. 1*a* the support device 18 is installed at both ends of the doctor 10. The support device is used for turning the beam to the desired position and it can also be used for loading the doctor. Generally the support device 18 comprises a swing arm 19, immovably fixed to the shaft 15, and an actuator 20 connected thereto. The end component of the treatment equipment according to the invention is shown in greater detail in FIGS. 2*a* and 2*b*. According to the invention, in connection with the bearing assembly 16 there is unexpectedly an auxiliary arm 21. The auxiliary arm 21 is adapted free in the radial direction and locked in the axial direction in relation to the bearing assembly 16. That is, the auxiliary arm can be pivoted while it remains in place in the axial direction. In addition there is a connection 22 between the swing arm 19 and the auxiliary arm 21. The connection 22 permits the axial movement of the swing arm 19 in relation to the auxiliary arm 21 without a radial distortion of the swing arm 19. Consequently, the swing arm 19 connected to the beam 12 can move in the axial direction. In addition, the connection 22 transmits the support force from the actuator 20, which is arranged between the bearing assembly 16 and the auxiliary arm 21. By means of the proposed solution, the oscillation movement remains a pure linear movement, and as the result, the doctor blade wears uniformly and the blade loading is kept stable.

For clarity, the actuator is not shown in FIG. 2*a*, which however shows a cross-sectional view of the support arm 23 attached to the bearing assembly 16. The actuator 20 can be of a conventional design, and it is attached between the support arm 23 and the auxiliary arm 21. Generally the auxiliary arm 21 is mounted, free in the radial direction, on the same swing axis as the shaft 15 by means of a bearing assembly. In FIG. 2*b* the auxiliary arm 21 comprises a ring 24, which is fitted with a suitable bearing. Furthermore, extra loadings can be avoided by arranging the actuator 20 essentially at the connection 22 in the axial direction. In this way the force from the actuator is transmitted directly from the auxiliary arm to the swing arm through the connection. The movement of the auxiliary arm 21 is illustrated with a double-headed arrow in FIG. 2*b*. In FIG. 2*b* the actuator 20 is attached in the immediate vicinity of the connection 22. The attachment point of the actuator can also be in some other point of the ring, in which case more freedom is achieved for the positioning of the actuator than heretofore.

To enable the axial movement of the swing arm 19 the connection 22 comprises elements, composed of roller bearings 25 or slide bearings 26. Generally the roller element 27 included in the roller bearing 25 is arranged in the swing arm 19 or in the auxiliary arm 21. In this case, there are axial direction counter surfaces 28 arranged correspondingly in the auxiliary arm 21 or the swing arm 19 for the roller element 27. In FIG. 2*a* the roller element 27 is adapted in the swing arm 19, but it can as well be set in the auxiliary arm 21. For clarity, only one counter surface 28 is shown in FIG. 2*a*. In FIG. 2*b*, on the contrary, both counter surfaces are shown, in which case the connection functions to both directions. In the proposed embodiment the roller element 27 is a roller 29, which rolls in a slot 31 formed by plate components 30. For transmitting the force, the roller 29 is set in the tangential direction. That is, the roller 29 is mounted with bearings on the radial shaft of the auxiliary arm 21.

FIG. 3*a* shows the swing arm 19 of FIG. 2*b* separated from the construction. The swing arm 19 also includes a roller element 27 formed by the roller 29. If necessary, suitable adjustment elements are arranged between the connection and the swing arm for adapting the various parts in a correct position in relation to each other. Generally the slide element 44 included in the slide bearing 26 is arranged in the swing arm 19 or in the auxiliary arm 21. In this case, there are axial direction counter surfaces 28 arranged correspondingly in the auxiliary arm 21 or the swing arm 19 for the slide element 44. A clearance-free connection can be easily obtained with the proposed slide bearing assembly. Here the slide element 44 is composed of a dowel pin 32, with the corresponding cylindrical hole 33 being made in the auxiliary arm 21. The solution is simple, but allows a smaller angle difference between the swing arm and the auxiliary arm than the roller 29 shown in FIG. 3*a*.

The roller bearing can also be made clearance-free by arranging at least two roller elements 27 in it for example as shown in FIG. 4*a*. In this case, clearances can be removed by adjusting the position of the roller elements in relation to the counter surfaces. FIG. 4*b* shows one solution for adjusting the position of the roller elements. Here the rollers 29 have eccentrically set shafts 34, which allows adjusting the position by pivoting the shaft 34. Finally the shaft is locked in place.

FIGS. 5*a* and 5*b* show a second embodiment of the treatment equipment according to the invention. Here the shaft 15 is supported to the beam 12 by means of an intermediate arm 35. In this case the swing arm 19 is composed of a combination of lugs 37, beam 12, and intermediate arm 35. In this embodiment, too, the auxiliary arm 21 is mounted by bearings on the same swing axis as the shaft 15. FIG. 5*b* illustrates the connection 22, which is composed of the slide bearing 26. The same reference numbers are used for functionally similar parts. Preferably, a cylindrical joint pin 36 is attached to the auxiliary arm 21, in which case the counter surfaces of the slide bearing 26 are in the lugs 37 attached to the beam 12. This allows achieving sufficiently large and durable slide surfaces. In this embodiment, too, it is possible to use a conventional actuator 10, which is supported to a crossbeam 38 supporting the bearing assembly 16.

Such treatment equipment also exists in which the above described actuators are not needed. In these treatment devices the beam is immovably fixed to a certain position. For loading and adjustment, the blade holder is equipped with separate loading elements. That is, the beam is fixed in a certain position by means of a support element arranged in the end component. According to the invention, the support element is composed of the auxiliary arm 21 arranged in connection with the bearing assembly 16. The auxiliary arm 21 is unexpectedly adapted to the same direction as the swing arm 19 and locked in both radial and axial directions in relation to the bearing assembly 16. In addition, there is a connection 22 between the swing arm 19 and the auxiliary arm 21, allowing for the swing arm 19 to move in the axial direction in relation to the auxiliary arm 21 without a radial distortion of the swing arm 19. In this case the swing arm can move freely in the axial direction together with the beam. FIG. 1*b* shows an embodiment without an actuator, in which the connection 22 is composed of two functional joints 39. In the joints 39 the swing axes of the pivoting points are parallel, in which case a parallel displacement of the arms is possible and almost frictionless at the same time.

The functional joints 39 are preferably made as one double joint 40. In this case the parallelism of the swing axes can be ensured. In addition, the double joint 40 is preferably connected to the auxiliary arm 21 and/or the swing arm 19 by means of the adjustment elements 41. FIG. 1*b* illustrates one simple adjustment element 41, which is composed of curved slots 42. In this case the position of the double joint 40, attached with two screws, can be changed in relation to the swing arm 19. The actual positioning of the beam 12 is made by changing the attachment of the auxiliary arm 21 to the bearing assembly 16. For this the auxiliary arm is provided with closely distributed holes 43. The accuracy of the adjustment can be improved by adding holes in the swing arm, too.

FIGS. 6*a* and 6*b* show a swing arm 19 and an auxiliary arm 21 connected with a double joint 40. In practice, the auxiliary arm is kept in place all the time while the swing arm is moving axially. The double joint 40 enables this movement while it simultaneously transfers the support force from the auxiliary arm to the swing arm. A double joint is extremely maintenance-free and withstands various operating conditions. Consequently, it can be well applied in difficult paper machine conditions. In addition to the proposed, the connection can include elements that enable the axial movement of the swing arm, composed of roller bearings or slide bearings, as in the above described embodiments of the treatment equipment equipped with an actuator.

The treatment equipment according to the invention and especially the associated connection that enables the axial movement is simple and reliable. The connection can be implemented in many different ways providing a suitable connection for the treatment equipment concerned. In addition, the connection requires only a reduced installation space and generated frictional forces are small. The connection can also be easily made clearance-free, which eliminates vibration problems of the beam.

The invention claimed is:

1. Treatment equipment, including a beam, for a paper machine, the beam having a shaft disposed along an axial direction at both of its end components, equipped with a bearing assembly, which is attached to the paper machine frame and adapted to allow the beam to pivot in relation to the bearing assembly and move in the axial direction, and the said treatment equipment further comprising a support device at least in one of the end components of the beam for turning the beam, and an oscillator for moving the beam back and forth in the axial direction, and the said support device comprising a radially disposed swing arm rigidly connected to the shaft and an actuator connected thereto, characterized by a connection with the bearing assembly including an auxiliary arm, movable in the radial direction and fixed in the axial direction relative to the bearing assembly, and an articulated connector disposed between the swing arm and the auxiliary arm allowing the axial movement of the swing arm in relation to the auxiliary arm without a radial distortion of the swing arm and transmitting a support force from the actuator, which is arranged between the bearing assembly and the auxiliary arm.

2. Treatment equipment according to claim 1, characterized in that the auxiliary arm is mounted with bearings, free in the radial direction, on essentially the same swing axis as the shaft.

3. Treatment equipment according to claim 1 or 2, characterized in that the actuator is arranged in axial direction essentially at the connection.

4. Treatment equipment according to claim 1, characterized in that the connection comprises elements enabling the axial movement of the said swing arm, and composed of roller bearings or slide bearings.

5. Treatment equipment according to claim 4, characterized in that the roller element included in the roller bearing is arranged in the swing arm or in the auxiliary arm, with axial direction counter surfaces arranged correspondingly in the auxiliary arm or in the swing arm for the roller element.

6. Treatment equipment according to claim 5, characterized in that the roller bearing comprises at least two roller elements, the position of which is adaptably adjustable in relation to the counter surfaces for removing clearances from the connection.

7. Treatment equipment according to claim 4, characterized in that the slide element included in the slide bearing is arranged in the swing arm or in the auxiliary arm, with axial direction counter surfaces arranged correspondingly in the auxiliary arm or in the swing arm for the slide element.

8. Treatment equipment, including a beam, for a paper machine, the beam having a shaft disposed along an axial direction at both of its end components, equipped with a bearing assembly, which is attached to the paper machine frame and adapted to allow the beam to pivot in relation to the bearing assembly and move in the axial direction, and the said treatment equipment further comprising a support device at least in one of the end components of the beam for supporting the beam in the desired position, and an oscillator for moving the beam back and forth in the axial direction, and the said support device comprising a radially disposed swing arm rigidly connected to the shaft and a support element connected thereto, characterized in that the support element includes an auxiliary arm arranged in connection with the bearing assembly, the auxiliary arm being disposed generally parallel to the swing arm and leaked fixed in both radial and axial directions relative to the bearing assembly, and an articulated connector disposed between the swing arm and the auxiliary arm allowing the axial movement of the swing arm relative to the auxiliary arm without a radial distortion of the swing arm and transmitting the a support force from the auxiliary arm.

9. Treatment equipment according to claim 8, characterized in that the connection is composed of two functional joints, in which swing axes of the pivoting points are parallel.

10. Treatment equipment according to claim 9, characterized in that the functional joints are made as one double joint, which is connected to the auxiliary arm and/or swing arm by means of the adjustment elements.

11. Treatment equipment according to claim 8, characterized in that the connection comprises elements that enable the axial movement of the said swing arm and are composed of roller bearings or slide bearings.

* * * * *